US005115953A

United States Patent [19]

Werner

[11] Patent Number: 5,115,953

[45] Date of Patent: May 26, 1992

[54] KNIFE SCABBARD WITH PRELOADED AND LOCKED INSERT PANEL FOR IMPROVED KNIFE RETENTION

[76] Inventor: Wesley W. Werner, 1622 Conard, Garden City, Kans. 67846

[21] Appl. No.: 703,846

[22] Filed: May 21, 1991

[51] Int. Cl.[5] ..... B26B 29/02; B65D 25/10

[52] U.S. Cl. ..... 224/232; 224/242; 224/245

[58] Field of Search ..... 224/232, 234, 242, 245; 30/143, 151, 152, 153, 162, 164

[56] References Cited

U.S. PATENT DOCUMENTS

| | | | |
|---|---|---|---|
| 2,783,536 | 3/1957 | McQueary | 224/245 |
| 3,191,825 | 6/1965 | Beckwith | 224/245 |
| 4,404,747 | 9/1983 | Collins | 224/232 |
| 4,414,744 | 11/1983 | Collins | 224/232 |
| 4,720,030 | 1/1988 | Petrovich | 224/232 |

*Primary Examiner*—Henry J. Recla
*Assistant Examiner*—David J. Walczak
*Attorney, Agent, or Firm*—John R. Flanagan

[57] ABSTRACT

A knife scabbard includes a holder sheath and insert panel removably installed into the sheath in interfitting relation therewith to define a cavity therebetween. The insert panel has upper and lower portions capable of yieldably and resiliently flexing from an initial configuration existing prior to installation of the insert panel into the sheath, to a different final configuration in response to insertion of the knife in the cavity and engagement of the insert panel with the sheath and knife. In the initial configuration, the upper and lower portions of the insert panel are in an unloaded condition, whereas in the final configuration, they are in a loaded condition respectively against the handle and blade of the knife. The upper and lower portions of the insert panel will return to their initial configuration and unloaded condition in response to removal of the insert panel from the sheath. The scabbard also includes releasable locking elements at the lower ends of the insert panel and sheath which interfit in a locking relationship with one another and are retained in that relationship by the loaded condition of the insert panel. The locking elements take the form of a protrusion having a head protruding rearwardly from the lower end of the insert panel and a matching hole formed in the lower end of the sheath into which the protruding head fits.

16 Claims, 5 Drawing Sheets

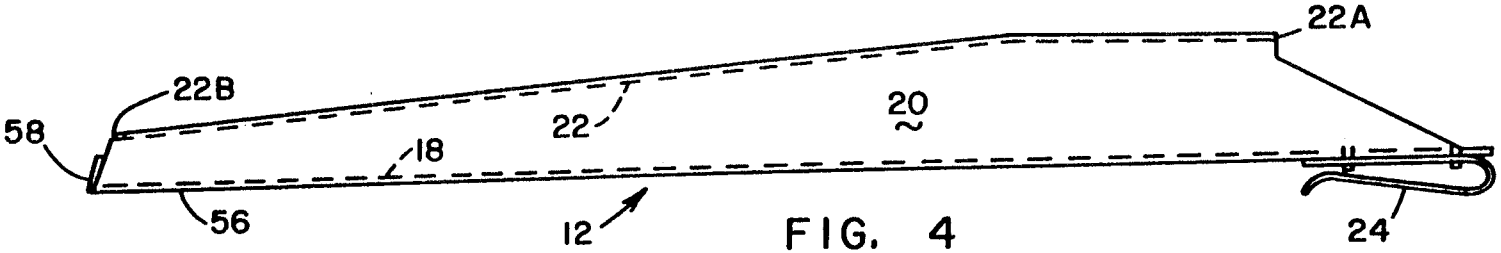
FIG. 4
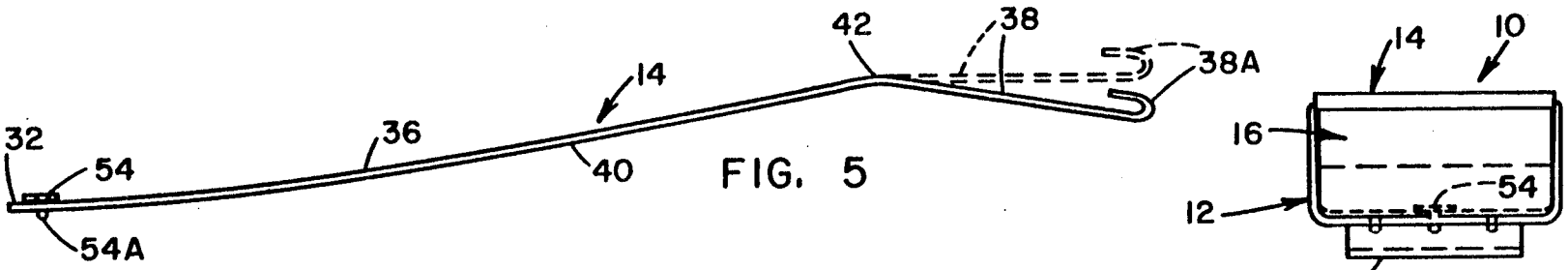
FIG. 5
FIG. 3
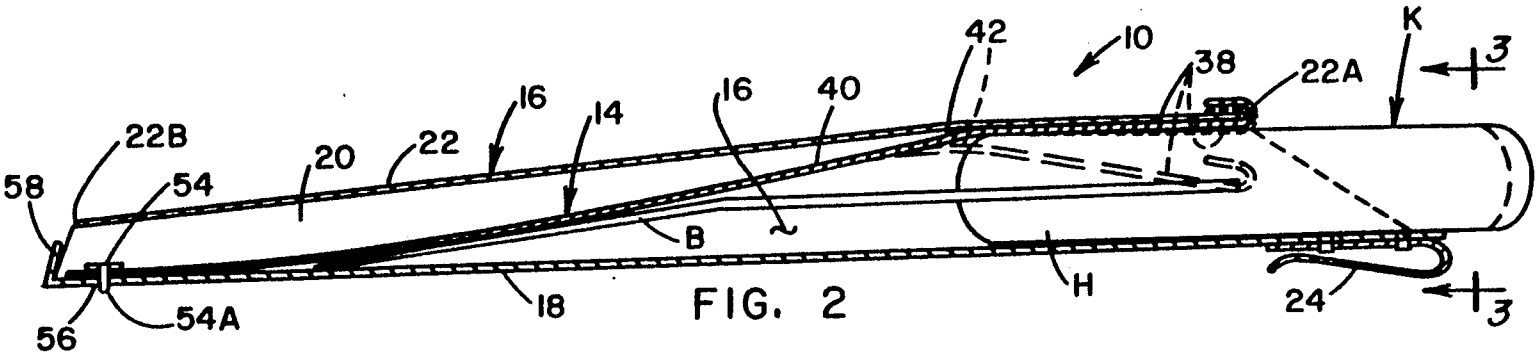
FIG. 2

KNIFE SCABBARD WITH PRELOADED AND LOCKED INSERT PANEL FOR IMPROVED KNIFE RETENTION

BACKGROUND OF THE INVENTION

1. Field of the Invention

The present invention generally relates to knife scabbards and, more particularly, is concerned with a knife scabbard employing a preloaded, releasably locked, insert panel to assist in retaining a knife within a cavity of the scabbard.

2. Description of the Prior Art

Receptacles adapted to receive and hold knives used by butchers and others engaged in slaughtering tasks are known as knife scabbards. Representative examples of prior art scabbards are those discloses in Puke et al. (U.S. Pat. No. 1,431,487), Baust (U.S. Pat. No. 1,504,927), Nies (U.S. Pat. No. 1,812,302), Roberge (U.S. Pat. No. 2,236,382), Tyson (2,399,522), Brickey (U.S. Pat. No. 2,424,302), Rutledge, Jr. (U.S. Pat. No. 2,903,171) and Bowers (Des. U.S. Pat. No. 250,824).

At the present time, knife scabbards being used have constructions basically similar to those of the Brickey and Rutledge, Jr. patents. As exemplified by the Rutledge, Jr. patent, the basic design of this prior art scabbard includes a receptacle having a sheath in the form of a back plate with a pair of opposite forwardly-extending, downwardly-converging side walls with inturned retaining flanges on their forward edges, and a knife clamping and wedging flat front plate which can be inserted into the sheath between the side walls and removed therefrom.

The front plate can slide longitudinally of the back plate between the side walls so as to define a tapered knife-clamping cavity therebetween. A resilient downturned lip is provided on the upper edge of the front plate which hooks over the tops of the inturned retaining flanges on the side walls. The lower end of the cavity is open permitting drainage of moisture from the knives.

Scabbards of this design presently in use have several drawbacks. First, they hold the knives in place by wedging them between the back and front plates of the scabbard. This imposes a force on knife handle in a direction which urges the knife to withdraw from the scabbard, thus making it easy for the knife to be dislodged and fall out when the scabbard is laid down or dropped.

Second, these prior art scabbards commonly have a loop fixed to the front surface of the front plate for receiving and hanging a meat hook used by the same slaughtering house workers. The hook point is exposed and creates a serious safety hazard. Some scabbards have plastic covers available as an add-on option. However, they are not widely used as they can be easily punctured by the hook point and do not give adequate protection.

Consequently, a need exists for improvements which will overcome the drawbacks of these prior art knife scabbards.

SUMMARY OF THE INVENTION

The present invention provides a knife scabbard designed to satisfy the aforementioned need. The scabbard can be constructed to hold a single knife or multiple knives positioned side-by-side one another. The knife scabbard employs a preloaded, releasably locked, insert panel to ensure retention of a knife or knives within a cavity defined between the insert panel and a holder sheath of the scabbard.

Accordingly, the present invention is directed to a scabbard for holding a knife having a blade and a handle. The scabbard comprises: (a) a holder sheath; and (b) an insert panel removably installable into the sheath in interfitting relation therewith so as to define a cavity between the insert panel and sheath. The insert panel has upper and lower portions capable of resiliently flexing from an initial configuration existing prior to installing the insert panel into the sheath in which the upper and lower portions of the insert panel are in an unloaded condition, to a different final configuration in response to insertion of the knife into the cavity and engagement of the insert panel with the sheath and knife in which the upper and lower portions of the insert panel are in a loaded condition respectively against the handle and blade of the knife. The upper and lower portions of the insert panel will return to their initial configuration and unloaded condition in response to removal of the insert panel from the sheath.

More particularly, the upper and lower portions of the insert panel are capable of resiliently flexing from their initial configuration to another different, intermediate configuration in response to installation of the insert panel into the sheath, but prior to insertion of the knife in the cavity. In their intermediate configuration, the upper and lower portions of the insert panel are placed in a preloaded condition for applying a load to the handle and blade of the knife upon insertion into the cavity.

In the embodiment of the scabbard for holding only one knife, the insert panel includes one transverse bend located between the upper and lower portions of the panel. The bend is located closer to an upper end than to lower end of the insert panel. However, preferably, in the embodiment of a scabbard for holding two or more knives, the insert panel has a pair of transverse bends located between the upper and lower portions of the panel. The bends are spaced vertically from one another and made in opposite directions with respect to one another.

In the initial configuration of the upper and lower portions of the insert panel, the panel has a generally arcuate shape in the longitudinal direction with the upper and lower portions lying in substantially non-parallel intersecting planes with respect to one another. In the embodiment of the scabbard for holding just one knife, as the upper and lower portions of the insert panel resiliently flex from their initial configuration through their intermediate to final configuration, the non-parallel intersecting planes of the upper and lower portions become more nearly coplanar and the arcuate shape of the insert panel becomes more nearly flat than in the initial configuration so as to apply an increased amount of surface area against the handle and blade of the knife. In the embodiment of the scabbard for holding two or more knives, as the upper and lower portions of the insert panel resiliently flex from their initial configuration through their intermediate to final configuration, the non-parallel planes of the upper and lower portions become more nearly parallel and offset than in the initial configuration so as to additionally define side-by-side pockets in the upper portion of the insert panel for seating the handles of the multiple knives while applying an increased amount of surface area against the handles and blades of the multiple knives.

Also, the scabbard includes releasable locking elements at the lower ends of the insert panel and the sheath. The locking elements interfit in a locking relationship with one another and are retained in that relationship by the loaded condition of the insert panel. The locking elements take the form of a protrusion having a head protruding rearwardly from the lower end of the insert panel and a matching hole formed in the lower end of the sheath into which the protruding head fits. The insert panel can be unlocked and removed by a user simply pushing in on the protrusion head protruding through the hole in the sheath as the user pulls upwards on the insert panel.

Further, the scabbard includes a locking flange, bracket, and a cover mounted on the insert panel and sheath for receiving a hook implement and locking it in a stationary position on the scabbard. The locking flange and bracket are on the upper and lower portions of the insert panel and the cover is on the lower portion of the sheath. The bracket and locking element cooperate to lock the handle of the hook implement in the stationary position on the insert panel. The cover on the lower end of the sheath encloses a curved end of the hook implement having a pointed end.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 2 is a longitudinal sectional view of the single knife scabbard of FIG. 1 illustrating the insert panel assembled to the sheath of the scabbard.

FIG. 3 is an end elevational view of the single knife scabbard as seen along line 3—3 of FIG. 2.

FIG. 4 is a side elevational view of the sheath of the single knife scabbard as seen along line 4—4 of FIG. 1.

FIG. 5 is a side elevational view of the insert panel of the single knife scabbard as seen along line 5—5 of FIG. 1.

DETAILED DESCRIPTION OF THE PREFERRED EMBODIMENTS

Figure 1:
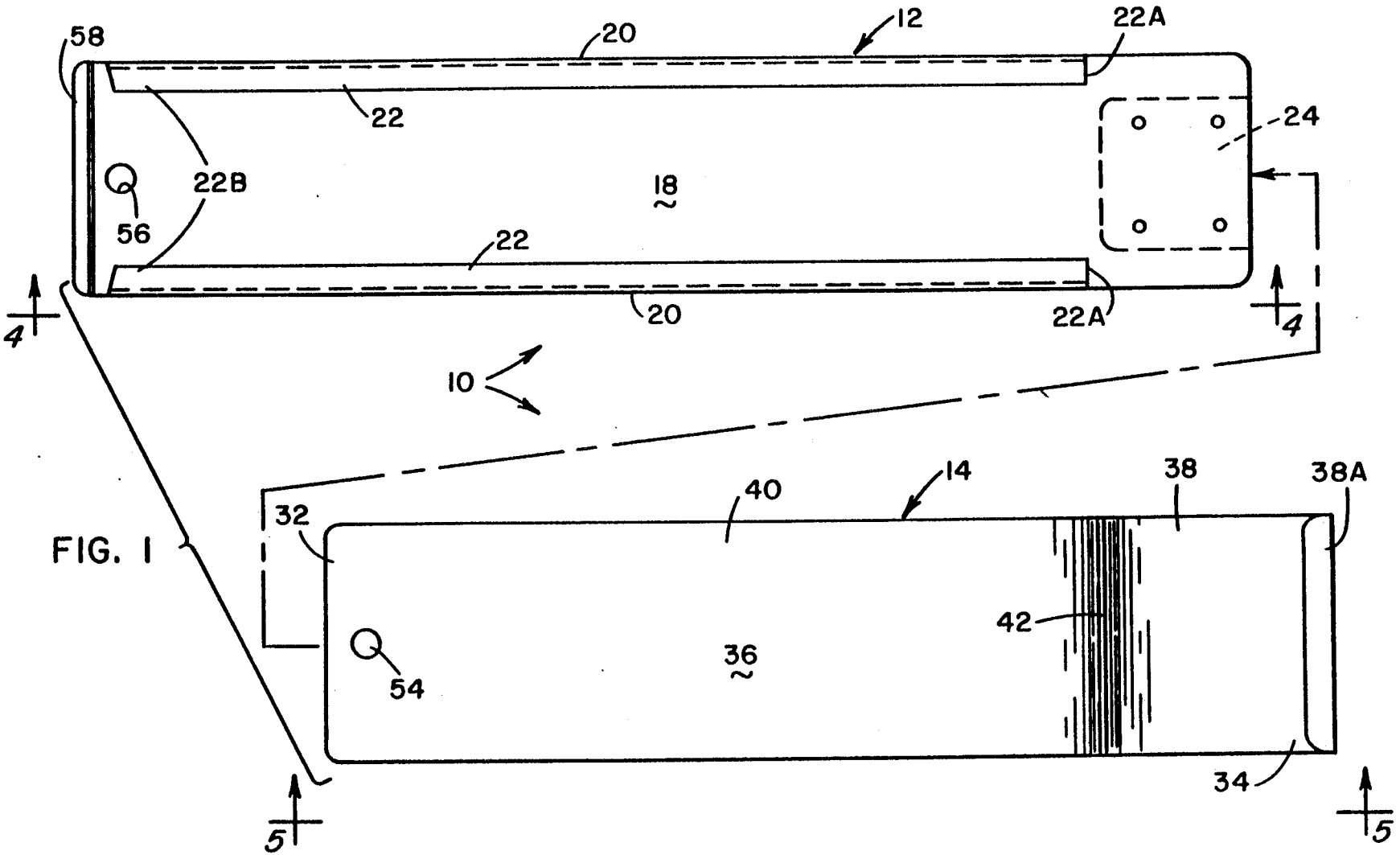
FIG. 1 is a plan view of a single knife scabbard of the present invention illustrating the insert panel disassembled from the sheath of the scabbard.

Referring to the drawings, and particularly to FIGS. 1–4, there is illustrated a single knife scabbard, generally designated 10, constructed in accordance with the principles of the present invention for holding a single knife K having a blade B and a handle H. In FIGS. 6–10, a multiple knife scabbard, generally designated 10, is illustrated. Both single and multiple knife scabbards 10 basically include a holder sheath 12 and an insert panel 14 removably installed into the sheath 12 in interfitting relation therewith so as to define a knife-holding cavity 16 between the sheath 12 and insert panel 14. The holder sheath 12 and insert panel 14 preferably are fabricated from any suitable material, such as plastic or aluminum.

The holder sheath 12 of the knife scabbard 10 is composed of a flat back wall 18 and a pair of forwardly-extending opposite side walls 20 having inturned flanges 22 on their forward edges. An upper portion of the back wall 18 of the sheath 12 can incorporate any one of the various features for supporting the scabbard 10 from a belt or part of the clothing of the user. For instance, any of the different versions of mounting clips 24, 26 and 28, shown respectively in FIGS. 1–3, 11–12 and 13–16, can be used, or the mounting slots 30, shown in FIGS. 6–8, can be used.

The insert panel 14 of the knife scabbard 10 is a resilient semi-flexible semi-rigid sheet having a lower or leading end 32 and an upper or trailing end 34 and defining a front wall 36 of the scabbard. The insert panel 14 is removably installed, leading end 32 first, into the holder sheath 12. When installed, the insert panel 14 is located between the opposite side walls 20 of the sheath 12 in interfitting relation with the inturned flanges 22 thereon so as to define the knife-holding cavity 16 between the front wall 36 of the insert panel 14 and the back wall 18 of the sheath 12.

More particularly, the insert panel 14 has upper and lower portions 38, 40. In the single knife scabbard 10 of FIGS. 1–5, the insert panel 14 also includes one transverse bend 42 located between the upper and lower portions 38, 40 of the panel 14 and made in a rearward direction toward the back wall 18 of the sheath 12. The bend 42 is located closer to the upper end 34 than to the lower end 32 of the insert panel 14. In the multiple knife scabbard 10 of FIGS. 6–10, the insert panel 14 has a pair of transverse upper and lower bends 44, 46 located between the upper and lower portions 38, 40 of the panel 14. The upper and lower bends 44, 46 are spaced vertically from one another and made in opposite directions with respect to one another and to the back wall 18 of the sheath 12. The insert panel 14 in the multiple scabbard 10 of FIGS. 6–10 also includes an intermediate portion 48 extending between the upper and lower bends 44, 46 and interconnecting the upper and lower portions 38, 40 of the panel 14. In both single and multiple scabbards 10, the upper portion 38 has a folded-over hook-shaped top end 38A which interfits with the top edges 22A of the inturned flanges 22 of the sheath 12, as can be seen in FIGS. 2 and 7.

The upper and lower portions 38, 40 of the insert panel 14 for the single and multiple knife scabbards 10 are capable of resiliently deflecting, or flexing, about the respective bends 42 and 44, 46 from an initial configuration and unloaded condition existing prior to installation of the panel 14 into the sheath 12 to a final configuration and loaded condition in response to installation of the panel 14 into the sheath 12 and insertion of the knife K into the cavity 16. The upper and lower portions 38, 40 of the insert panel 14 for the single knife scabbard 10 of FIGS. 1–5 flex about the single transverse bend 42 formed in the panel 14. The upper portion 38 of the panel 14 for the multiple knife scabbard 10 of FIGS. 6–10 flexes about the upper transverse bend 44, whereas the lower portion 40 flexes about the lower transverse bend 46. The upper and lower portions 38, 40 of the panel 14 in each of the single and multiple knife scabbards 10 will automatically return to the initial configuration and unloaded condition in response to removal of the panel 14 from the sheath 12.

Also, the upper and lower portions 38, 40 of the insert panel 14 are capable of resiliently flexing first from the initial configuration to an intermediate configuration in response to installation of the insert panel 14 into the sheath 12, but prior to insertion of the knife K in the cavity 16. In the intermediate configuration, the upper and lower portions 38, 40 of the insert panel 14 are placed in a preloaded condition for applying a load to the handle H and blade B of the knife K upon insertion of the latter into the cavity 16. The interfitted relation of the folded-over top end 38A with the top edges 22A of the inturned flanges 22 of the sheath 12 retains the upper and lower portions 38, 40 in the intermediate configuration and preloaded condition, while providing sufficient clearance therebetween to permit additional flexing of the upper and lower portions 38, 40 to the final configuration and loaded condition upon insertion of the knife K.

Figure 10:
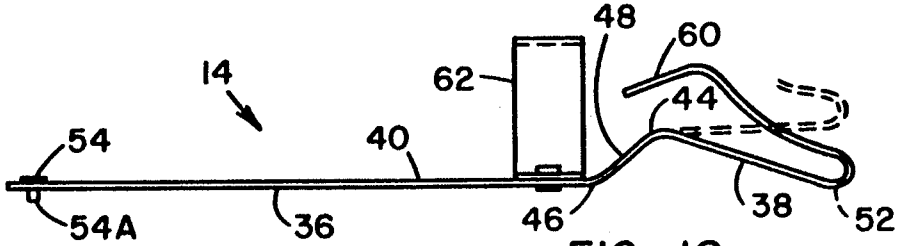
FIG. 10 is a side elevational view of the insert panel of the multiple knife scabbard as seen along line 10—10 of FIG. 6.

In the initial configuration of the upper and lower portions 38, 40 of the insert panel 14 of both single and multiple knife scabbards 10 illustrated respectively in FIGS. 5 and 10, the insert panel 14 has a generally arcuate shape in the longitudinal direction. The upper and lower portions 38, 40 lie in substantially non-parallel intersecting planes with respect to one another.

In the single knife scabbard 10 of FIG. 2, the upper and lower portions 38, 40 of the insert panel 14 can resiliently flex from the initial unloaded configuration (shown in long dashed line form in FIG. 2 and solid line form in FIG. 5) through the intermediate preloaded configuration (shown in short dashed line form in FIGS. 2 and 5) to final loaded configuration (shown in solid line form in FIG. 2). As the upper and lower portions 38, 40 flex in such manner, the non-parallel intersecting planes of the upper and lower portions 38, 40 become more nearly coplanar and the arcuate shape of the insert panel 14 becomes more nearly flat than in the initial unloaded configuration. The flattening of the insert panel 14 serves to apply an increased amount of surface area against the handle H and blade B of the knife K.

In the multiple knife scabbard 10 of FIG. 7, the upper and lower portions 38, 40 of the insert panel 14 can resiliently flex from the initial unloaded configuration (shown in long dashed line form in FIG. 7 and solid line form in FIG. 10) through the intermediate preloaded configuration (shown in short dashed line form in FIGS. 7 and 10) to final loaded configuration (shown in solid line form in FIG. 7). As the upper and lower portions 38, 40 flex in such manner, the non-parallel planes of the upper and lower portions 38, 40 become more nearly parallel and offset than in the initial unloaded configuration. The parallel and offset relation of the upper and lower portions 38, 40 serves to define side-by-side pockets 50 in the upper portion 38 of the insert panel 14 for seating the handles H of the multiple knives K, while applying an increased amount of surface area against the handles H and blades B of the multiple knives K.

Figure 6:
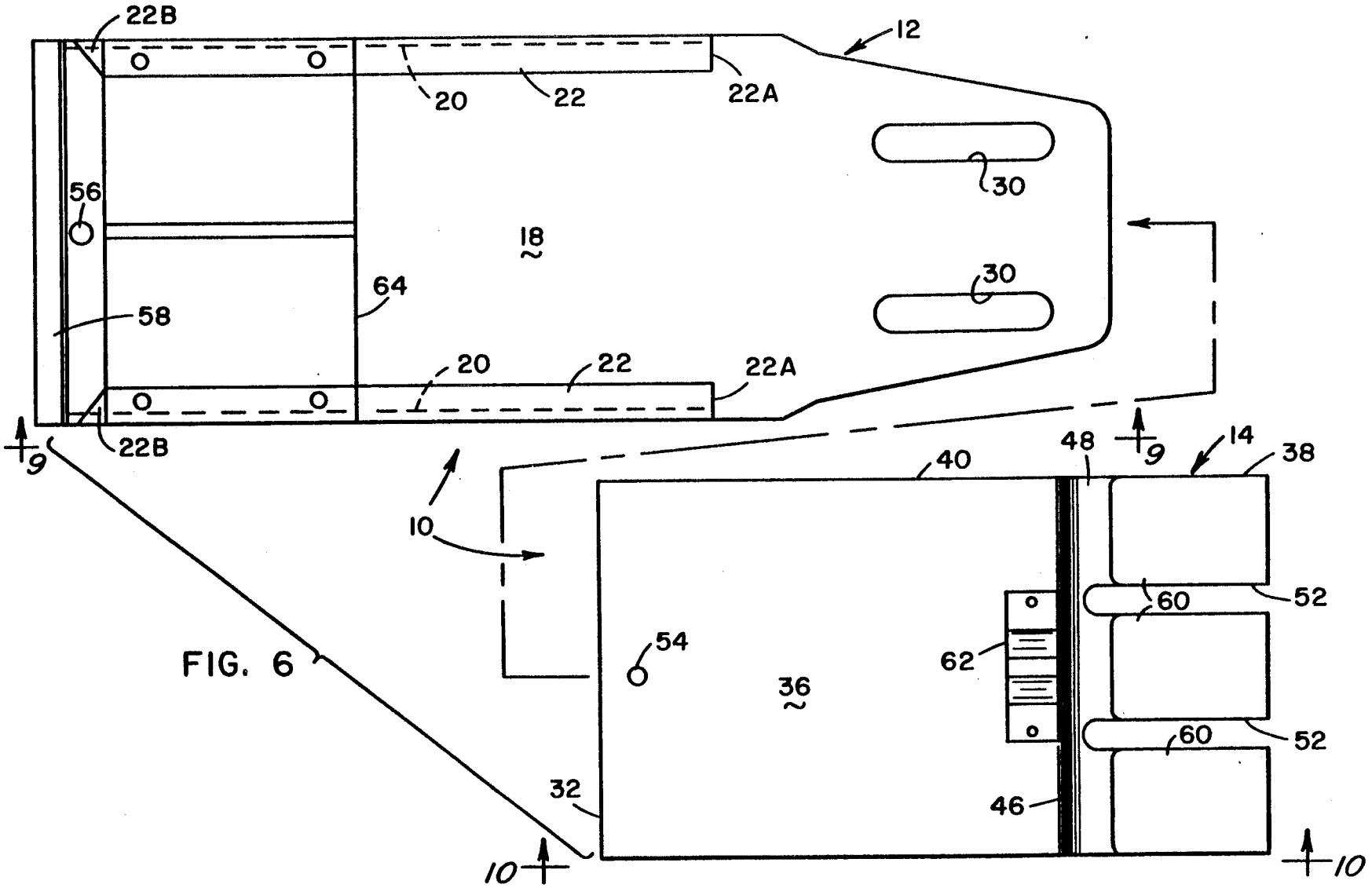
FIG. 6 is a plan view of a multiple knife scabbard of the present invention illustrating the insert panel disassembled from the sheath of the scabbard.
Figure 9:
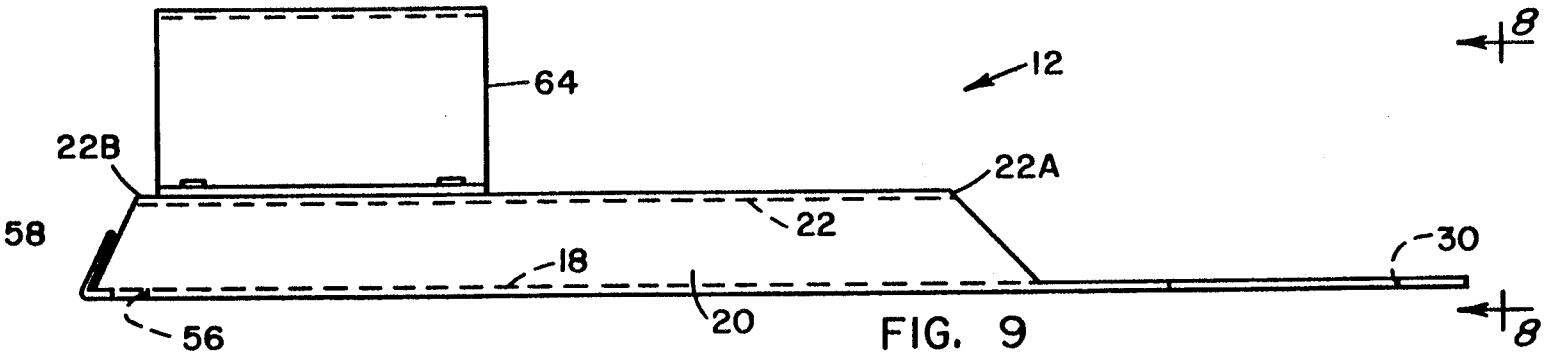
FIG. 9 is an end elevational view of the sheath of the multiple knife scabbard as seen along line 9—9 of FIG. 8.
Figure 8:
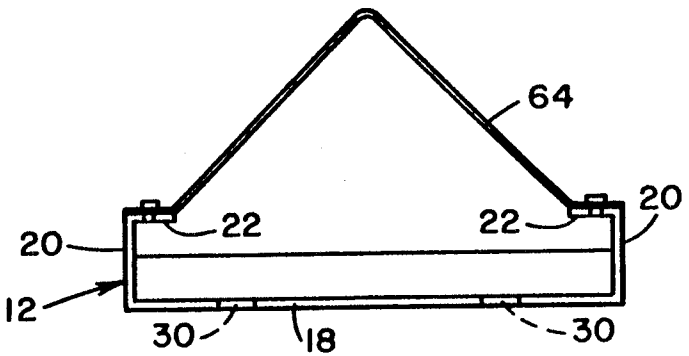
FIG. 8 is a side elevational view of the sheath of the multiple knife scabbard as seen along line 8—8 of FIG. 6.
Figure 7:
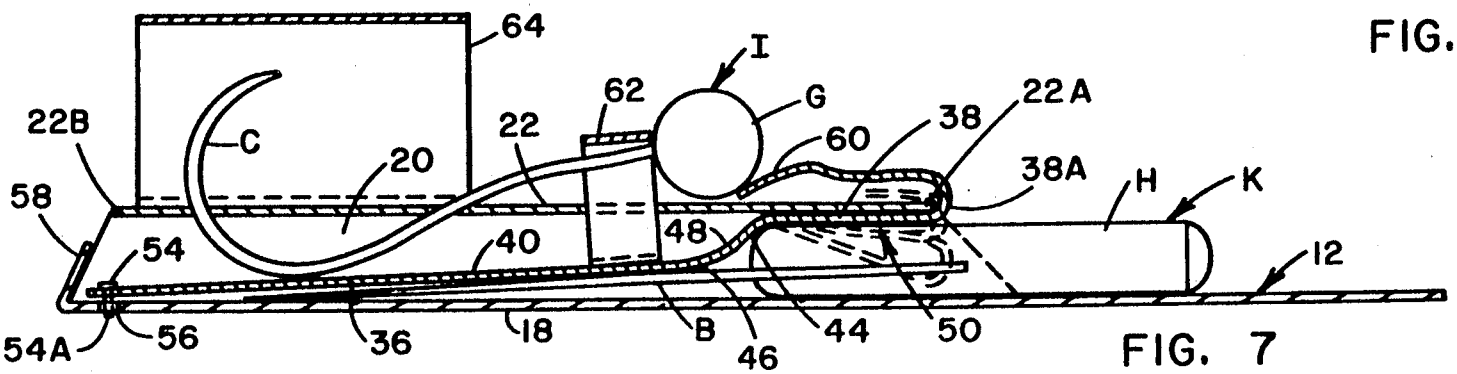
FIG. 7 is a longitudinal sectional view of the multiple knife scabbard of FIG. 6 illustrating the insert panel assembled to the sheath of the scabbard.
Figure 11:
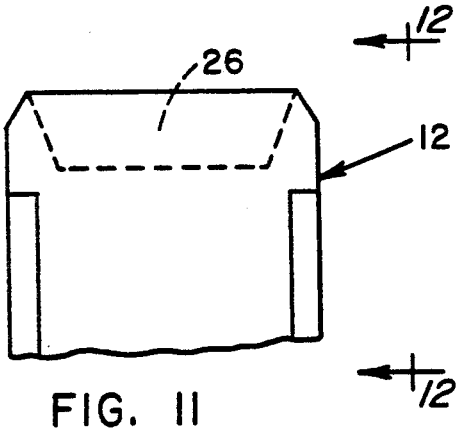
FIG. 11 is a fragmentary plan view of the sheath of the multiple knife scabbard incorporating a mounting clip instead of the mounting slots shown in FIG. 1.
Figure 12:
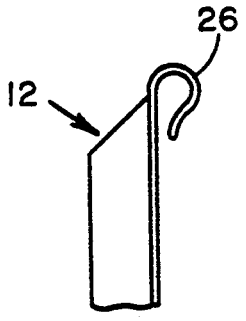
FIG. 12 is a fragmentary side elevational view of the sheath as seen along line 12—12 of FIG. 11.
Figure 13:
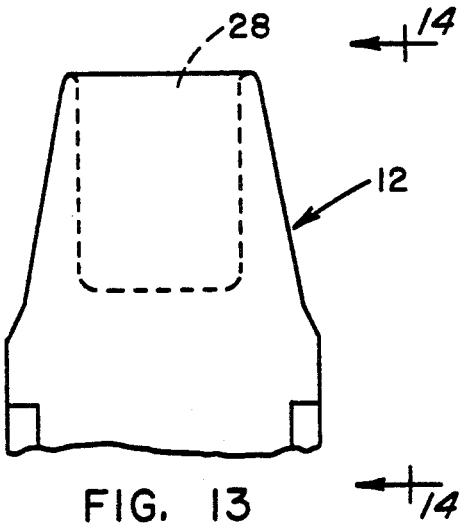
FIG. 13 is a fragmentary plan view of the sheath of the multiple knife scabbard incorporating another version of a mounting clip.
Figure 14:
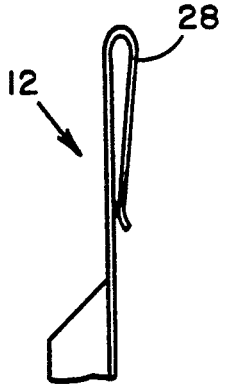
FIG. 14 is a fragmentary side elevational view of the sheath as seen along line 14—14 of FIG. 13.
Figure 15:
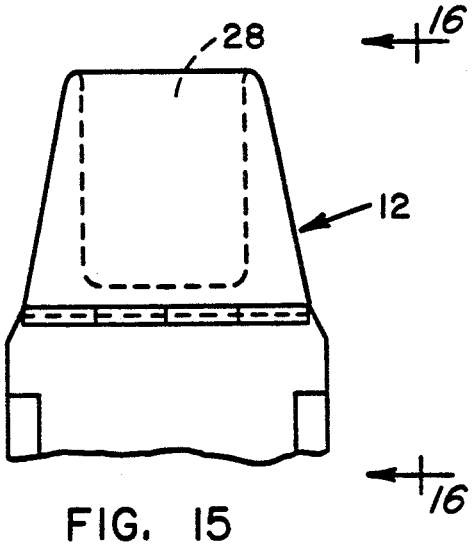
FIG. 15 is a fragmentary plan view of the sheath of the multiple knife scabbard incorporating still another version of a mounting clip.
Figure 16:
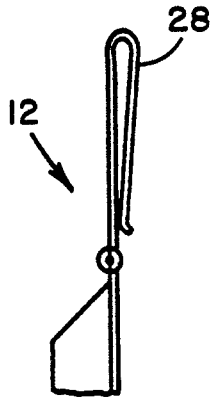
FIG. 16 is a fragmentary side elevational view of the sheath as seen along line 16—16 of FIG. 15.

As seen in FIG. 6, the upper portion 38 of the insert panel 14 of the multiple knife scabbard 10 also includes transversely-spaced longitudinal slots 52 extending downwardly from the top end 38A which tend isolate the load applied on the knife handle H at each of the pockets 50 from one another such that withdrawal of one knife does not affect the load on the handles of the knives remaining in the scabbard 10.

Referring to FIGS. 1, 2 and 5 showing the single knife scabbard 10 and to FIGS. 6, 7 and 10 showing the multiple knife scabbard 10, the respective single and multiple knife scabbards 10 include releasable locking elements 54, 56 at respective lower ends 32, 58 of the insert panel 14 and the back wall 18 of the sheath 12. The locking elements 54, 56 interfit in a locking relationship with one another and are retained in that relationship by the loaded condition of the insert panel 14. The locking elements 54, 56 take the form of a protrusion 54 having a head 54A protruding rearwardly from the lower end 32 of the insert panel 14 and a matching hole or slot 56 formed in the lower end 58 of the sheath back wall 18 through which the protruding head 54A extends. The insert panel 14 can be unlocked and removed by a user simply pushing in on the protrusion head 54A protruding through the hole 56 in the sheath back wall 18 as the user pulls upwards on the insert panel 14.

Further, referring to FIGS. 6–10, the multiple scabbard 10 includes a locking element 60, bracket 62, and a cover 64 for receiving a hook implement I and locking it in a stationary position on the scabbard 10. More particularly, the locking element 60 and bracket 62 are mounted on the exterior of the upper and lower portions 38, 40 of the insert panel 14, whereas the cover 64 is mounted on the lower ends 22B of the inturned flanges 22 of the holder sheath 12. The locking element 60 is an arcuate end flange on the upper end 34 of the panel 14. The bracket 62 and locking element 60 cooperate to lock the handle grip G of the hook implement I in the stationary position on the insert panel 14. The cover 64 on the lower ends 22B of the sheath inturned flanges 22 encloses a curved end C of the hook implement I which has a point thereon.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A scabbard for holding a knife having a blade and a handle, comprising:

(a) an elongated insert panel having upper and lower ends and being formed of an elongated resilient semi-rigid semi-flexible sheet;

(b) an elongated holder sheath including an elongated main wall having upper and lower ends and means attached to said main wall and extending between said upper and lower ends of said main wall for removably receiving said insert panel into interfitting relation with said sheath so as to define an elongated cavity between said insert panel and said main wall of said sheath extending from said upper ends of said insert panel and main wall of said sheath to said lower ends thereof;

(c) said insert panel also having upper and lower portions capable of resiliently flexing from an initial configuration and unloaded condition to a different final configuration and loaded condition in response to receipt of said insert panel by said receiving means of said sheath into said interfitting relation with said sheath and in response to insertion of a knife into said cavity and engagement of said insert panel with said sheath and the handle and blade of the knife, said upper and lower portions of said insert panel being capable of returning to said initial configuration and unloaded condition in response to removal of the knife and said insert panel from said sheath; and (d) means disposed adjacent said lower end of said insert panel and said lower end of said main wall of said sheath for releasably attaching said insert panel to said sheath.

2. The scabbard of claim 1 wherein said upper and lower portions of said insert panel are capable resiliently flexing from said initial configuration to an intermediate configuration, before flexing to said final configuration, in response to installation of said insert panel into said sheath and prior to insertion of the knife in said cavity, said upper and lower portions in said intermediate configuration being disposed in a preloaded condition for thereafter applying a load to the handle and blade of the knife upon insertion of the knife into said cavity.

3. The scabbard of claim 1 wherein said insert panel includes at least one transverse bend located between said upper and lower portions of said panel.

4. The scabbard of claim 3 wherein:

said insert panel in said initial configuration has a generally arcuate shape in the longitudinal direction thereof; and said upper and lower portions of said panel in said initial configuration and being located respectively above and below said one transverse bend lie in generally non-parallel intersecting planes with respect to one another;

said arcuate shape of said panel and said non-parallel intersecting planes of said upper and lower portions, as said upper and lower portions deform toward said final configuration, respectively become more nearly flat and coplanar than in said initial configuration so as to apply an increased amount of surface area against the handle and blade of the knife.

5. The scabbard of claim 3 wherein said bend is located closer to an upper end than to a lower end of said insert panel.

6. The scabbard of claim 1 wherein said insert panel includes at least a pair of transverse bends located between said upper and lower portions of said panel, said bends being spaced vertically from one another and made in opposite directions with respect to one another.

7. The scabbard of claim 6 wherein:

said insert panel in said initial configuration has a generally arcuate shape in the longitudinal direction thereof; and said upper and lower portions of said panel in said initial configuration and being located respectively above and below said pair of transverse bends lie in generally non-parallel intersecting planes with respect to one another;

said arcuate shape of said panel and said non-parallel intersecting planes of said upper and lower portions, as said upper and lower portions deform toward said final configuration, respectively become more nearly flat and more nearly parallel and offset than in said initial configuration so as to define side-by-side pockets in said upper portion of said insert panel for seating handles of multiple knives while applying an increased amount of surface area against the handles and blades of the multiple knives.

8. The scabbard of claim 1 wherein said releasable attaching means includses a pair of releasable locking elements disposed adjacent said lower end of said insert panel and said lower end of said main wall portion of said sheath, said locking elements capable of interfitting in a locking relationship with one another and being retained in that relationship by the loaded condition of said insert panel.

9. The scabbard of claim 8 wherein said locking elements includes:

a protrusion having a head protruding rearwardly from said lower end of said insert panel; and a hole formed in said lower end of said sheath matching said protruding head of said protrusion and into which said protruding head fits, said insert panel capable of being unlocked and removed by a user simply pushing in on said protrusion head protruding through said hole in said sheath as a user pulls upwards on said insert panel.

10. The scabbard of claim 1 further comprising:

a locking element mounted on said upper portion of said insert panel; and a bracket mounted on said lower portion of said insert panel and being cooperable with said locking element to lock the handle of the hook implement in a stationary position on said insert panel.

11. The scabbard of claim 10 further comprising:

a cover overlying said lower portion of said insert panel and mounted on said sheath adjacent a lower end thereof for enclosing a curved end of the hook implement having a pointed end.

12. The scabbard of claim 1 wherein:

said main wall of said holder sheath includes a flat back wall;

said receiving means of said holder sheath includes a pair of opposite side walls attached to and extending forwardly from opposite longitudinal edges of said flat back wall and having inturned flanges on forward edges of said side walls; and said insert panel provides a front wall removably installed into said sheath between said side walls thereof in interfitting relation with said inturned flanges thereof so as to define said elongated cavity between said insert panel and said back wall of said sheath.

13. A scabbard for holding a knife having a blade and a handle, comprising:

(a) an elongated insert panel having an upper end and a lower end and being formed of an elongated resilient semi-rigid semi-flexible sheet;

(b) an elongated holder sheath having an elongated flat wall with upper and lower ends and a pair of opposite side walls attached at rear edges thereof to opposite side edges of said flat wall and extending forwardly therefrom, said side walls having inturned flanges at forward edges thereof for removably receiving said insert panel into interfitting relation with said inturned flanges of said sheath so as to define an elongated cavity between said insert panel and said flat wall of said sheath extending from said upper ends of said insert panel and sheath wall to said lower ends thereof, said insert panel and said sheath wall thereby respectively defining front and back walls of said elongated cavity;

(c) said insert panel also having upper and lower portions capable of resiliently flexing from an initial configuration and unloaded condition to a different final configuration and loaded condition in response to receipt of said insert panel into said interfitting relation with said sheath and in response to insertion of a knife into said cavity and engagement of said insert panel with said sheath and the handle and blade of the knife, said upper and lower portions of said insert panel being capable of returning to said initial configuration and unloaded condition in response to removal of the knife and said insert panel from said sheath; and (d) a pair of releasable locking elements disposed adjacent said lower ends of said insert panel and sheath wall, said locking elements capable of interfitting in a locking relationship with one another and being retained in that relationship by the loaded condition of said insert panel.

14. The scabbard of claim 13 wherein said locking elements includes:

a protrusion having a head protruding rearwardly from said lower end of said insert panel; and a hole formed in said lower end of said sheath matching said protruding head of said protrusion and into which said protruding head fits, said insert panel capable of being unlocked and removed by a user simply pushing in on said head protruding through said hole in said sheath as a user pulls upwards on said insert panel.

15. The scabbard of claim 13 further comprising:

a locking element mounted on said upper portion of said insert panel; and a bracket mounted on said lower portion of said insert panel and being cooperable with said locking element to lock the handle of a hook device in a stationary position on said insert panel.

16. The scabbard of claim 15 further comprising:

a cover overlying said lower portion of said insert panel and mounted on said sheath adjacent of lower end thereof for enclosing a curved end of the hook device having a pointed end.

* * * * *